US005306353A

United States Patent [19]

Hayakawa et al.

[11] Patent Number: 5,306,353

[45] Date of Patent: Apr. 26, 1994

[54] METHOD OF PRODUCING GRAIN ORIENTED SILICON STEEL SHEETS HAVING LESS IRON LOSS

[75] Inventors: Yasuyuki Hayakawa; Michiro Komatsubara; Takahiro Kan; Hirotake Ishitobi; Katsuo Iwamoto, all of Chiba, Japan

[73] Assignee: Kawasaki Steel Corporation, Japan

[21] Appl. No.: 899,957

[22] Filed: Jun. 17, 1992

Related U.S. Application Data

[63] Continuation of Ser. No. 683,257, Apr. 10, 1991, abandoned.

[30] Foreign Application Priority Data

| | | | |
|---|---|---|---|
| Apr. 13, 1990 | [JP] | Japan | 2-96322 |
| Sep. 7, 1990 | [JP] | Japan | 2-235806 |
| Mar. 11, 1991 | [JP] | Japan | 3-69525 |

[51] Int. Cl.[5] ..... C21D 8/12

[52] U.S. Cl. ..... 148/111; 148/112; 148/113

[58] Field of Search ..... 148/111, 112, 113, 307, 148/308, 122

[56] References Cited

U.S. PATENT DOCUMENTS

| | | | |
|---|---|---|---|
| 4,576,658 | 3/1986 | Inokuti et al. | 148/111 |
| 4,698,272 | 10/1987 | Inokuti et al. | 148/308 |

FOREIGN PATENT DOCUMENTS

| | | |
|---|---|---|
| 2940779 | 4/1980 | Fed. Rep. of Germany . |
| 3334519 | 3/1984 | Fed. Rep. of Germany . |
| 0021531 | 2/1980 | Japan . |
| 58-217630 | 12/1983 | Japan . |
| 59-126722 | 7/1984 | Japan . |
| 59-222586 | 12/1984 | Japan . |
| 62-167820 | 7/1987 | Japan . |
| 62-167821 | 7/1987 | Japan . |
| 62-167822 | 7/1987 | Japan . |

*Primary Examiner*—R. Dean
*Assistant Examiner*—Sikyin Ip
*Attorney, Agent, or Firm*—Austin R. Miller

[57] ABSTRACT

In grain oriented silicon steel sheets containing MnSe as a main inhibitor, an iron loss is reduced by increasing the magnetic flux density and realizing the thinning of product thickness and fine division of crystal grains while utilizing the stability of secondary recrystallization as a merit of such a sheet. In this case, 0.02–0.30% of Cu is added to a slab of the above grain oriented silicon steel, and particularly the decarburization annealing and/or the final finish annealing are carried out under particular conditions.

9 Claims, 5 Drawing Sheets

METHOD OF PRODUCING GRAIN ORIENTED SILICON STEEL SHEETS HAVING LESS IRON LOSS

This application is a continuation of application Ser. No. 07/683,257, filed Apr. 10, 1991, now abandoned.

BACKGROUND OF THE INVENTION

1. Field of the Invention

This invention relates to a method of producing grain oriented silicon steel sheets suitable as a core material for use in transformer and other electric machinery and having less iron loss.

2. Related Art Statement

As a means of reducing iron loss of the grain oriented silicon steel sheet, there have hitherto been adopted 1) a method of increasing Si content, 2) a method of thinning product thickness, 3) a method of refining secondary recrystallized grains, 4) a method of reducing impurity content, 5) a method of highly aligning secondary recrystallized grains into (110)[001] orientation (called as Goss orientation), and the like. Among them, the method of increasing the Si content is not adaptable as an industrial production method because when the Si content exceeds 4 wt % (hereinafter shown by % merely), the cold rolling property is considerably degraded.

On the other hand, there are proposed various methods for reducing the product thickness. For example, in the grain oriented silicon steel sheet containing AlN as an inhibitor, Japanese Patent laid open No. 58-217630 and No. 59-126722 disclose a method wherein products having a thickness of 0.15–0.25 mm are obtained by adding Sn, Cu to the steel composition. Furthermore, in the grain oriented silicon steel sheet containing MnSe, MnS as an inhibitor, Japanese Patent laid open No. 62-167820, No. 62-167821 and No. 62-167822 disclose a method wherein products having a thickness of 0.15–0.25 mm are obtained and an average grain size after secondary recrystallization is within a range of 1–6 mm.

In the method of adding Sn and Cu to the grain oriented silicon steel sheet containing AlN as a main inhibitor as disclosed in Japanese Patent laid open No. 58-217630 and No. 59-126722, however, a relatively high magnetic flux density was obtained, but it could not be said that the improvement of iron loss was sufficient. For example, in Table 5 of Japanese Patent laid open No. 59-126722, the iron loss is 0.85–0.90 W/kg as $W_{17/50}$, which can not be said to be a satisfactory value. Furthermore, a proper reduction in final cold rolling exceeds 80% in the grain oriented silicon steel sheet containing AlN as a main inhibitor, but when the product thickness is not more than 0.23 mm, the secondary recrystallization becomes unstable and the probability for obtaining products having less iron loss rapidly decreases.

In the method of Japanese Patent laid open No. 62-167820, No. 62-167821 and No. 62-167822 aiming at the thinning and refining of crystal grain in the grain oriented silicon steel sheet containing MnSe, MnS as an inhibitor, the magnetic flux density is low as compared with the grain oriented silicon steel sheet containing AlN as a main inhibitor, and hence the hysteresis loss is poor. However, such a method is advantageous in the fine division of crystal grain, and hence the total iron loss is 0.83–0.88 W/kg as $W_{17/50}$ as shown in Table 2 of Japanese Patent laid open No. 62-167820, which is substantially equal to that in the case of using AlN as a main inhibitor.

However, it is hardly said that such a level of iron loss is fully satisfactory. Moreover, the optimum reduction in cold rolling is 55–88% in the grain oriented silicon steel sheet containing MnSe, MnS as a main inhibitor, so that even when the product thickness is not more than 0.23 mm, the secondary recrystallization becomes considerably stable as compared with the grain oriented silicon steel sheet containing AlN as a main inhibitor.

SUMMARY OF THE INVENTION

It is, therefore, an object of the invention to provide a method of advantageously producing grain oriented silicon steel sheets which can realize low iron loss by increasing the magnetic flux density and attaining reduction of product thickness and refining of crystal grain while utilizing the secondary recrystallization stability as a merit of the grain oriented silicon steel sheet containing MnSe as a main inhibitor.

According to a first aspect of the invention, there is the provision of a method of producing grain oriented silicon steel sheets having less iron loss by a series of steps of subjecting a slab of silicon steel comprising C: 0.02–0.08%, Si: 2.5–4.0%, Mn: 0.02–0.15%, Se: 0.010–0.060%, Sb: 0.01–0.20%, Cu: 0.02–0.30% and the balance being substantially Fe to hot rolling, subjecting the resulting hot rolled sheet to heavy cold rolling or two-stage cold rolling through an intermediate annealing up to a final product thickness, subjecting the resulting cold rolled sheet to a decarburization annealing, applying a slurry of an annealing separator consisting mainly of MgO to the surface of the sheet, and then subjecting the sheet to secondary recrystallization annealing and purification annealing, characterized in that said decarburization annealing is a treatment that the sheet is heated to 850°–1000° C. at a temperature rising rate of not less than 10° C./s and kept at this temperature range in a non-oxidizing atmosphere having a dew point of not higher than 15° C. for 5–60 seconds and further kept in a wet hydrogen atmosphere of 780°–850° C. for 30 seconds to 5 minutes.

According to a second aspect of the invention, there is the provision of a method of producing grain oriented silicon steel sheets having less iron loss by a series of steps of subjecting a slab of silicon steel comprising C: 0.02–0.08%, Si: 2.5–4.0%, Mn: 0.02–0.15%, Se: 0.010–0.060%, Sb: 0.01–0.20%, Cu: 0.02–0.30% and the balance being substantially Fe to hot rolling, subjecting the resulting hot rolled sheet to heavy cold rolling or two-stage cold rolling through an intermediate annealing up to a final product thickness, subjecting the resulting cold rolled sheet to a decarburization annealing, applying a slurry of an annealing separator consisting mainly of MgO to the surface of the sheet, and then subjecting the sheet to secondary recrystallization annealing and purification annealing, characterized in that said final product thickness is 0.12–0.23 mm, and said secondary recrystallization annealing is a treatment that the sheet is heated up to a certain temperature of 840°–900° C. at a temperature rising rate of not less than 15° C./h and kept at this temperature in a mixed atmosphere of Ar and $N_2$ for 30 minutes to 5 hours and further kept at a certain temperature lower by 20°–50° C. than the above temperature for not less than 20 hours.

According to a third aspect of the invention, there is the provision of a method of producing grain oriented silicon steel sheets having less iron loss by a series of steps of subjecting a slab of silicon steel comprising C: 0.02-0.08%, Si: 2.5-4.0%, Mn: 0.02-0.15%, Se 0.010-0.060%, Sb: 0.01-0.20%, Cu: 0.02-0.30% and the balance being substantially Fe to hot rolling, subjecting the resulting hot rolled sheet to heavy cold rolling or two-stage cold rolling through an intermediate annealing up to a final product thickness, subjecting the resulting cold rolled sheet to a decarburization annealing, applying a slurry of an annealing separator consisting mainly of MgO to the surface of the sheet, and then subjecting the sheet to secondary recrystallization annealing and purification annealing, characterized in that said final product thickness is 0.12-0.23 mm, and said annealing separator is added with 1-50 parts by weight as $Al_2O_3$ of a spinel type composite compound containing aluminum and 1-20 parts by weight as $TiO_2$ of a Ti compound based on 100 parts by weight of MgO.

According to a fourth aspect of the invention, there is the provision of a method of producing grain oriented silicon steel sheets having less iron loss by a series of steps of subjecting a slab of silicon steel comprising C: 0.02-0.08%, Si: 2.5-4.0%, Mn: 0.02-0.15%, Se: 0.010-0.060%, Sb: 0.01-0.20%, Cu: 0.02-0.30% and the balance being substantially Fe to hot rolling, subjecting the resulting hot rolled sheet to heavy cold rolling or two-stage cold rolling through an intermediate annealing up to a final product thickness, subjecting the resulting cold rolled sheet to a decarburization annealing, applying a slurry of an annealing separator consisting mainly of MgO to the surface of the sheet, and then subjecting the sheet to secondary recrystallization annealing and purification annealing, characterized in that said decarburization annealing is a treatment that the sheet is heated to 850°-1000° C. at a temperature rising rate of not less than 10° C./s and kept at this temperature range in a non-oxidizing atmosphere having a dew point of not higher than 15° C. for 5-60 seconds and further kept in a wet hydrogen atmosphere of 780°-850° C. for 30 seconds to 5 minutes, and said final product thickness is 0.12-0.23 mm, and said secondary recrystallization annealing is a treatment that the sheet is heated up to a certain temperature of 840°-900° C. at a temperature rising rate of not less than 15° C./h and kept at this temperature in a mixed atmosphere of Ar and $N_2$ for 30 minutes to 5 hours and further kept at a certain temperature lower by 20°-50° C. than the above temperature for not less than 20 hours.

According to a fifth aspect of the invention, there is the provision of a method of producing grain oriented silicon steel sheets having less iron loss by a series of steps of subjecting a slab of silicon steel comprising C: 0.02-0.08%, Si: 2.5-4.0%, Mn: 0.02-0.15%, Se: 0.010-0.060%, Sb: 0.01-0.20%, Cu: 0.02-0.30% and the balance being substantially Fe to hot rolling, subjecting the resulting hot rolled sheet to heavy cold rolling or two-stage cold rolling through an intermediate annealing up to a final product thickness, subjecting the resulting cold rolled sheet to a decarburization annealing, applying a slurry of an annealing separator consisting mainly of MgO to the surface of the sheet, and then subjecting the sheet to secondary recrystallization annealing and purification annealing, characterized in that said decarburization annealing is a treatment that the sheet is heated to 850°-1000° C. at a temperature rising rate of not less than 10° C./s and kept at this temperature range in a non-oxidizing atmosphere having a dew point of not higher than 15° C. for 5-60 seconds and further kept in a wet hydrogen atmosphere of 780°-850° C. for 30 seconds to 5 minutes, and said final product thickness is 0.12-0.23 mm, and said annealing separator is added with 1-50 parts by weight as $Al_2O_3$ of a spinel type composite compound containing aluminum and 1-20 parts by weight as $TiO_2$ of a Ti compound based on 100 parts by weight of MgO.

According to a sixth aspect of the invention, there is the provision of a method of producing grain oriented silicon steel sheets having less iron loss by a series of steps of subjecting a slab of silicon steel comprising C: 0.02-0.08%, Si: 2.5-4.0%, Mn: 0.02-0.15%, Se: 0.010-0.060%, Sb: 0.01-0.20%, Cu: 0.02-0.30% and the balance being substantially Fe to hot rolling, subjecting the resulting hot rolled sheet to heavy cold rolling or two-stage cold rolling through an intermediate annealing up to a final product thickness, subjecting the resulting cold rolled sheet to a decarburization annealing, applying a slurry of an annealing separator consisting mainly of MgO to the surface of the sheet, and then subjecting the sheet to secondary recrystallization annealing and purification annealing, characterized in that said decarburization annealing is a treatment that the sheet is heated to 850°-1000° C. at a temperature rising rate of not less than 10° C./s and kept at this temperature range in a non-oxidizing atmosphere having a dew point of not higher than 15° C. for 5-60 seconds and further kept in a wet hydrogen atmosphere of 780°-850° C. for 30 seconds to 5 minutes, and said final product thickness is 0.12-0.23 mm, and said secondary recrystallization annealing is a treatment that the sheet is heated up to a certain temperature of 840°-900° C. at a temperature rising rate of not less than 15° C./h and kept at this temperature for 30 minutes to 5 hours and further kept at a certain temperature lower by 20°-50° C. than the above temperature for not less than 20 hours, and said annealing separator is added with 1-50 parts by weight as $Al_2O_3$ of a spinel type composite compound containing aluminum and 1-20 parts by weight as $TiO_2$ of a Ti compound based on 100 parts by weight of MgO.

In anyone of the above first to sixth inventions, the slab of silicon steel comprises C: 0.02-0.08%, Si: 2.5-4.0%, Mn: 0.02-0.15%, Se: 0.010-0.060%, Sb: 0.01-0.20%, Cu: 0.02-0.30%, Mo: 0.005-0.05% and the balance being substantially Fe.

In anyone of the above first to sixth inventions, the slab of silicon steel comprises C: 0.02-0.08%, Si: 2.5-4.0%, Mn: 0.02-0.15%, Se: 0.010-0.060%, Sb: 0.01-0.20%, Cu: 0.02-0.30%, at least one of Sn: 0.02-0.30% and Ge: 0.005-0.50% and the balance being substantially Fe.

In anyone of the above first to sixth inventions, the slab of silicon steel comprises C: 0.02-0.08%, Si: 2.5-4.0%, Mn: 0.02-0.15%, Se: 0.010-0.060%, Sb: 0.01-0.20%, Cu: 0.02-0.30%, Mo: 0.005-0.05%, at least one of Sn: 0.02-0.30% and Ge: 0.005-0.50% and the balance being substantially Fe.

BRIEF DESCRIPTION OF THE DRAWINGS

The invention will be described with reference to the accompanying drawings, wherein.

DESCRIPTION OF THE PREFERRED EMBODIMENTS

Figure 1:
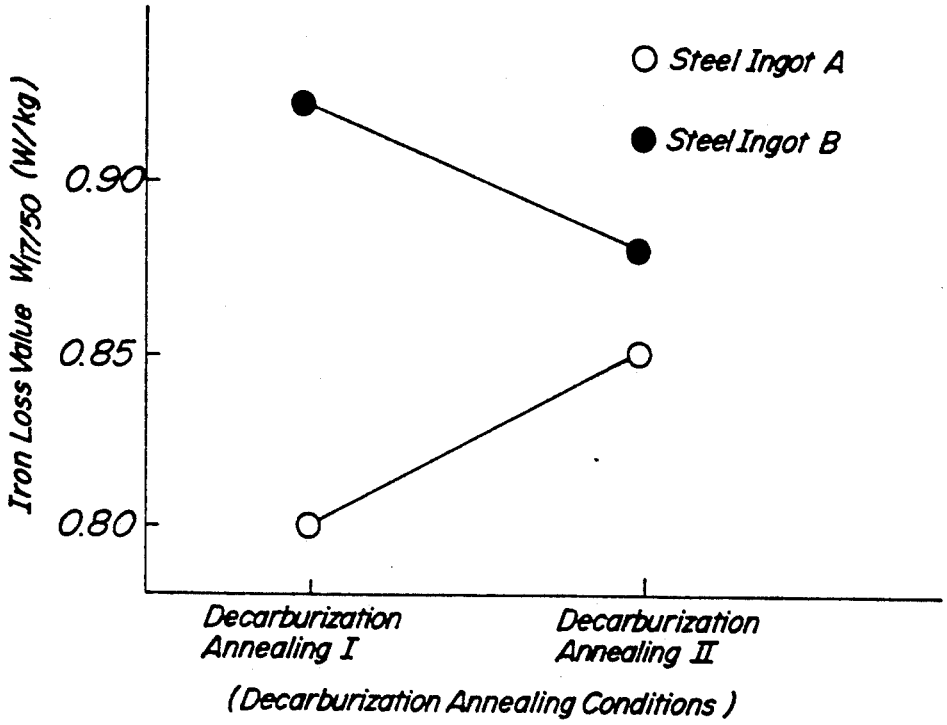
FIG. 1 is a graph showing a relation between decarburization annealing and iron loss value.

The invention will be described in detail below.

As a problem in the grain oriented silicon steel sheet containing MnSe as a main inhibitor, the magnetic flux density is low as previously mentioned. This is mainly considered due to the fact that the reinhibitation effect of MnSe as an inhibitor is insufficient, so that according to the invention, Cu is included into steel for reinforcing the restraining force.

Moreover, the method wherein Cu is included into the grain oriented silicon steel sheet containing MnSe, MnS as a main inhibitor has been disclosed in Japanese Patent laid open No. 54-32412, No. 58-2340 and No. 61-159531. In this method, however, there is no consideration on decarburization annealing conditions as well as the reduction of product thickness and refining of crystal grain, and also the magnetic properties are still insufficient.

Heretofore, the decarburization of the grain oriented silicon steel sheet containing MnSe, MnS as a main inhibitor has been carried out as a step for the formation of glass film and the decarburization that the sheet is annealed in a decarburizing atmosphere of about 800°-850° C. Moreover, Japanese Patent laid open No. 51-78733 discloses an improving technique of decarburization in which the sheet is kept at 530°-700° C. for 30 seconds to 30 minutes before the decarburization annealing and then the decarburization is carried out at 740°-880° C. In Japanese Patent laid open No. 60-121222 is disclosed a technique that the sheet is rapidly heated at a temperature rising rate of not less than 10° C./s up to a temperature range of 400°-750° C., and kept within a temperature range of 780°-820° C. at a ratio $P(H_2O)/P(H_2)$ of 0.4-0.7 for 50 seconds to 10 minutes and further kept within a temperature range of 830°-870° C. at a ratio $P(H_2O)/P(H_2)$ of 0.08-0.4 for 10 seconds to 5 minutes. In these methods, however, the improvement of magnetic properties is insufficient, and particularly the magnetic flux density is undesirably low.

The inventors have made minute studies on the decarburization annealing of the grain oriented silicon steel sheet containing MnSe and Cu as an inhibitor and found the following novel knowledges and as a result, the first invention has been accomplished.

The experimental results leading in success of the first invention will be described below.

An ingot of each of steel A containing C: 0.043%, Si: 3.39%, Mn: 0.082%, Se: 0.019%, Sb: 0.028% and Cu: 0.12% and steel B containing C: 0.040%, Si: 3.30%, Mn: 0.076%, Se: 0.020% and Sb: 0.026% was melted, heated at 1350° C. for 30 minutes and then hot rolled to a thickness of 2.0 mm. Then, the hot rolled sheet was annealed at 1000° C. for 30 seconds, cold rolled to a middle thickness of 0.52 mm, subjected to an intermediate annealing at 950° C. for 90 seconds and further cold rolled to a thickness of 0.20 mm. Thereafter, the decarburization annealing was carried out by (I) a method wherein the sheet was heated at a rising rate of 20° C./s and kept at a temperature of 950° C. in $N_2$ atmosphere having a dew point of 0° C. for 30 seconds and further kept at a temperature of 820° C. in $H_2$ atmosphere having a dew point of 60° C. for 90 seconds, or (II) a method wherein the sheet was heated at a rising rate of 18° C./s and kept at 820° C. in $H_2$ atmosphere having dew point of 60° C. for 120 seconds. Next, the sheet was coated with a slurry of MgO, kept at 840° C. for 50 hours and then kept at 1200° C. in $H_2$ atmosphere.

The magnetic properties of the thus obtained product sheets were measured to obtain results as shown in FIG. 1.

As seen from FIG. 1, the iron loss value is best in the steel ingot A containing Cu and subjected to decarburization annealing under conditions of the method I. On the contrary, in the steel ingot B containing no Cu, when the decarburization annealing is carried out under conditions of the method I, the iron loss value is rather degraded as compared with the decarburization annealing conducted under usual conditions of the method II. On the other hand, even in the steel ingot A, the good iron loss value is not obtained under the decarburization annealing conditions II. From these facts, it is understood that the good iron loss value can not be obtained only by adding Cu to the steel.

The reason why the magnetic properties are improved by the above treatment is guessed as follows.

That is, the conventional decarburization annealing had simultaneously attained two different phenomena of decarburization and primary recrystallization. The decarburization reaction was proceeded by reacting C in steel with steam in the atmosphere on the steel sheet surface to form CO. In this case, the temperature range suitable for the decarburization was 780°-850° C. As the temperature became lower, the decarburization reaction rate was too slow and the reaction did not proceed, while as the temperature became higher, the atmosphere was shut off from the sheet surface through a thick surface oxide layer formed in the annealing and hence the reaction did not proceed. For this end, the temperature for the decarburization annealing was said to be 780°-850° C.

Grains of Goss orientation being a secondary recrystallization nucleus in the grain oriented silicon steel are existent in the recrystallization texture formed in the decarburization annealing. In order to obtain good magnetic properties, it is necessary to increase grains of Goss orientation in the recrystallization texture.

The inventors have examined (110) pole intensity corresponding to the intensity of Goss orientation grain in the texture formed after the decarburization annealing by means of X-ray diffraction when the cold rolled sheet of 0.20 mm in thickness made from the above steel ingot A is used and the temperature rising rate and soaking temperature ar changed in the decarburization annealing.

Figure 2:
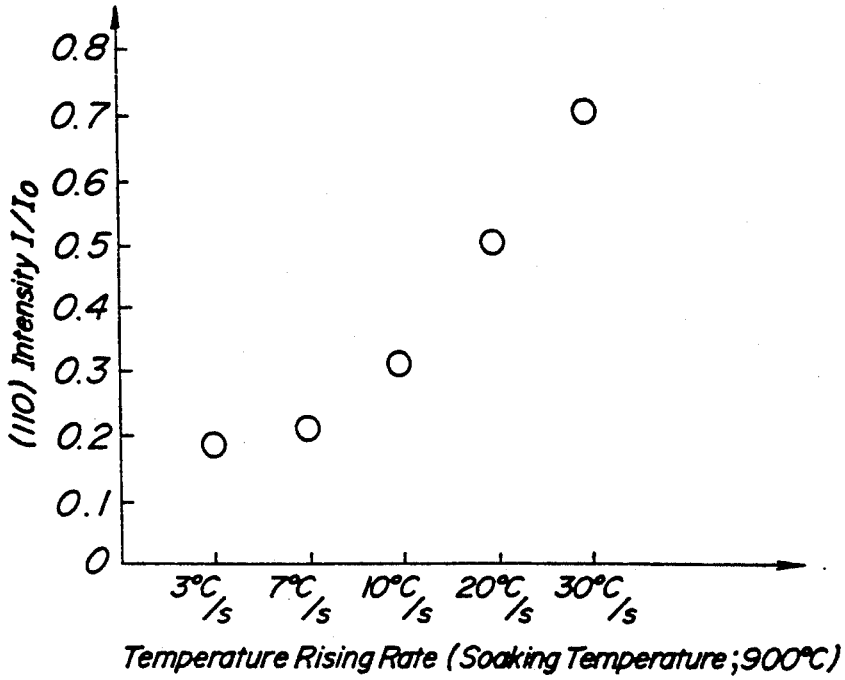
FIG. 2 is a graph showing a relation between temperature rising rate and (110) face intensity in the decarburization annealing.
Figure 3:
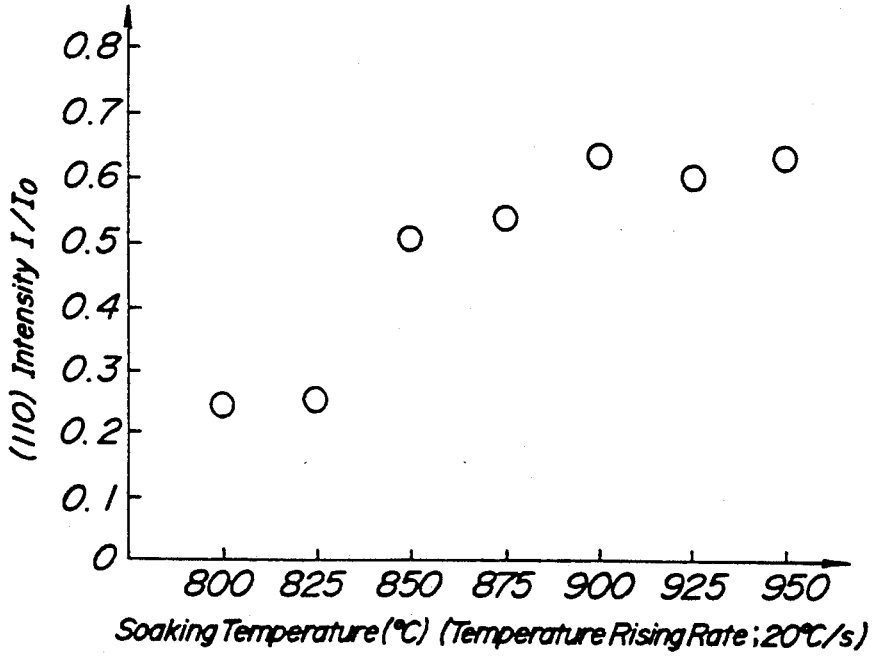
FIG. 3 is a graph showing a relation between soaking temperature and (110) face intensity in the decarburization annealing.

A relation between temperature rising rate and (110) pole intensity is shown in FIG. 2, and a relation between soaking temperature and (110) pole intensity is shown in FIG. 3.

As seen from FIGS. 2 and 3, the (110) pole intensity is strong as the temperature rising rate becomes large and the soaking temperature becomes high.

According to the first invention, therefore, the temperature rising rate is not less than 10° C./s and the soaking temperature is 850°-1000° C. in the first half of the decarburization annealing. Under such annealing conditions, the presence of Goss orientation grain being a secondary recrystallization nucleus considerably increases as compared with the conventional annealing of 780°-850° C. aiming at the completion of the decarburization.

Furthermore, in the first half of the decarburization annealing according to the first invention, it is necessary that the annealing atmosphere is a non-oxidizing atmosphere in order to effectively suppress the formation of oxide layer obstructing the last half of the decarburization annealing.

As a factor influencing on the secondary recrystallization, there is the presence of an inhibitor controlling the growth of grains other than Goss orientation grain in addition to the aforementioned texture. When MnSe is merely used as an inhibitor, Ostwald growth of precipitates proceeds within the temperature range of 850°-1000° C. useful for the formation of the texture in the first half of the decarburization annealing according to the invention and hence the reinhibitation effect of the inhibitor is lost and good magnetic properties can not be obtained.

According to this invention, the reduction of the reinhibitation effect of such an inhibitor can be prevented by adding Cu to steel.

That is, Cu in steel is bound to Se likewise Mn to form $Cu_{2-x}Se$. This $Cu_{2-x}Se$ is finely dispersed after the hot rolling as compared with MnSe, so that it can develop a reinhibitation effect stronger than that of the case using MnSe alone as an inhibitor. Therefore, it is considered that the reduction of the reinhibitation effect is prevented by an effect of reinforcing the reinhibitation effect of the inhibitor realized by the addition of Cu to steel even at the recrystallization annealing step of 850°-1000° C. increasing Goss orientation grains in the primary recrystallized texture. Furthermore, it is considered that the increased Goss orientation grains are subjected to secondary recrystallization at subsequent final finish annealing step, whereby products having low iron loss and high magnetic flux density are obtained.

As mentioned above, according to the first invention, Cu is added to the grain oriented silicon steel sheet containing MnSe as a main inhibitor, which is subjected to recrystallization annealing aiming at the increase of Goss orientation grains in the first half of the decarburization annealing and further to annealing aiming at the usual decarburization in the last half thereof, whereby not only the good texture is formed but also the complete decarburization is attained to provide good magnetic properties.

The second invention will be described below.

The inventors have made minute studies on final finish annealing of grain oriented silicon steel sheet containing MnSe and Cu as an inhibitor and having a final sheet thickness of not more than 0.23 mm and found the following new knowledges and as a result the second invention has been accomplished.

That is, the grain oriented silicon steel sheets having less iron loss can be obtained by such a secondary recrystallization annealing of the grain oriented silicon steel sheet containing MnSe and Cu as an inhibitor that the sheet is heated up to a certain temperature of 840°-900° C. at a temperature rising rate of not less than 15° C./h, kept at this temperature in a mixed atmosphere of Ar and $N_2$ for 30 minutes to 5 hours and then kept at a certain temperature lower by 20°-50° C. than the above temperature for not less than 20 hours, preferably about 50 hours.

The reason why the iron loss is advantageously improved according to the above steps is considered as follows.

As previously mentioned, Cu in steel is bound to Se likewise Mn to form $Cu_{2-x}Se$. The actual precipitate is a composite precipitate of MnSe and $Cu_{2-x}Se$. As a result, it has been confirmed that the precipitation behavior is changed to increase the precipitation amount below 900° C., which is different from the case of using only MnSe as an inhibitor. The inventors have noticed this point and found that the precipitation amount of $Cu_{2-x}Se$ increases when the the sheet is kept at a certain temperature within a range precipitating $Cu_{2-x}Se$ (840°-900° C.) at an initial stage of the secondary recrystallization annealing. Therefore, it is considered that the reinhibitation effect of the inhibitor is strengthened by such an increase of the precipitation amount to increase the magnetic flux density and hence develop the thinning of the product thickness and refining of crystal grain at maximum, whereby the low iron loss is attained.

Furthermore, it has newly been found that the magnetic flux density more increases when the atmosphere keeping a temperature between 840° C. and 900° C. at the initial stage of the secondary recrystallization annealing is a mixed atmosphere of Ar and $N_2$. Although the reason is not clear, it is considered that when the atmosphere is only $N_2$ atmosphere in the case of containing Cu, Al as a slight component forms AlN and combines with $Cu_{2-x}Se$ to change the property of the inhibitor so that Ar is included for eliminating the above bad influence to more improve the magnetic flux density.

As mentioned above, the second invention is a method of reducing the iron loss by effectively applying the precipitation behavior of the inhibitor newly found by the inventors to the grain oriented silicon steel sheet containing MnSe as a main inhibitor and Cu.

The third invention will be described below.

The third invention has been accomplished by making minute studies on the annealing separator independently of the second invention and finding the following new knowledge.

That is, the iron loss can more be improved by adding 1-50 parts by weight as $Al_2O_3$ of a spinel type composite oxide containing aluminum and 1-20 parts by weight as $TiO_2$ of Ti compound to the MgO annealing separator based on 100 parts by weight of MgO in the final finish annealing of the grain oriented silicon steel sheet containing MnSe and Cu as an inhibitor.

Reason why the iron loss is improved by the above treatment is considered as follows.

When the product thickness is thin and particularly is not more than 0.23 mm, the secondary recrystallization becomes unstable in accordance with the final finish annealing conditions and hence the magnetic properties largely change. In this case, the final finish annealing is actually carried out by box annealing every coil.

Prior to the final finish annealing, MgO is applied to the sheet surface. In general, MgO is forcedly agitated with water to form a slurry, which is then applied to the steel sheet surface. A part (several percentage) of MgO at the slurry state changes into $Mg(OH)_2$, which is decomposed at 400°-500° C. to release $H_2O$. This released $H_2O$ oxidizes the surface of the steel sheet to promote the decomposition of the inhibitor existent in the surface layer.

Such a surface oxidation is harmful for obtaining good magnetic properties. Particularly, in the box annealing of coil, the vapor dissipation from spaces between coil laminations is very poor, so that the surface is exposed to an oxidizing atmosphere produced by $H_2O$ released from $Mg(OH)_2$, and hence the surface oxidation is vigorous and the properties are degraded. Furthermore, when the product thickness is too thin (not more than 0.23 mm), the influence of oxidation behavior on the surface is large, so that the degradation becomes considerably conspicuous.

In this connection, the inventors have found that the degradation of the properties resulted from the oxidizing atmosphere of the spaces between coil laminations can effectively be prevented by adding Cu to the starting steel and adding the spinel type composite oxide containing aluminum and the Ti compound to the annealing separator. The reason is considered as follows.

That is, the above is considered due to the synergistic action of the following three effects:

(1) when Cu is added to steel, the oxidation reaction at the surface is suppressed to control the decomposition of the inhibitor such as MnSe, $Cu_{2-x}Se$ and the like;

(2) when $TiO_2$ is added to the annealing separator, forsterite layer is strongly formed;

(3) the penetration of Ti being harmful for the reduction of iron loss into steel can be suppressed by adding the spinel type composite oxide containing aluminum.

Namely, the surface oxidation of the steel sheet is suppressed owing to the presence of Cu soluted in steel, whereby the function of the inhibitor is effectively acted to provide an improved secondary recrystallized texture, but if the thickness of the steel sheet is thin, the following phenomenon becomes undesirably conspicuous.

The forsterite layer (or glass film) on the surface of the steel sheet applies tension to the steel sheet surface to provide an effect of reducing the iron loss, but when the oxidation property of the atmosphere between the layers of the steel sheet coil is high in the secondary recrystallization annealing, the properties of the resulting coating layer are degraded to decrease the tension effect. When the tension effect is decreased with the thinning of the product thickness, the amount of iron loss increases, which becomes a serious problem in the grain oriented silicon steel thin sheet.

In order to improve the uniformity of the forsterite layer and the adhesion property, the addition of Ti compound to the annealing separator has hitherto been known to be effective. The inventors have found that the above addition enhances tension effect and has an effect of improving the iron loss property in the grain oriented silicon steel thin sheet containing Cu, Sb.

However, it has been confirmed that the single addition of Ti component to the annealing separator inversely degrades the iron loss property because Ti penetrates into steel in the final finish annealing.

According to the third invention, therefore, the spinel type composite oxide containing aluminum is also added to the annealing separator for suppressing the penetration of Ti into steel, whereby the reduction of iron loss based on the effective tension application is realized.

A great merit of the third invention lies in a point that it is not necessary to complicatedly control the atmosphere with Ar and $N_2$ in the secondary recrystallization annealing as in the second invention.

Because the penetration of nitrogen into steel is suppressed by the action of aluminum in the alumina spinel added to the annealing separator. That is, even if the atmosphere control is not carried out, Al as a slight component in steel forms AlN, whereby there is caused no drawback of changing $Cu_{2-x}Se$ as an inhibitor.

As mentioned above, the third invention provides low iron loss by adding Cu to the grain oriented silicon steel sheet containing MnSe as a main inhibitor and effectively utilizing a new fact that the bad influence of oxidation on the atmosphere between layers of the coil can be removed by adding the spinel type composite oxide containing aluminum and the Ti compound to the annealing separator as well as the aforementioned effect of suppressing the change in the property of the inhibitor.

The reason why the chemical composition of the steel according to the invention is limited to the above range is as follows.

C: 0.02–0.08%

C is an element useful for uniform refining of the microstructure during the hot rolling and the cold rolling and developing the Goss orientation. When the C amount is less than 0.02%, the secondary recrystallization is poor, while when it exceeds 0.08%, the decarburization is difficult, so that the C amount is limited to a range of 0.02–0.08%.

Si: 2.5–4.0%

Si effectively contributes to increase the specific resistance of the steel sheet and reduce the iron loss. When the Si amount is less than 2.5%, the good iron loss value is not obtained, while when it exceeds 4.0%, the cold rolling ability is considerably degraded, so that the Si amount is limited to a range of 2.5–4.0%.

Mn: 0.02–0.15%, Se: 0.010–0.060%

Mn and Se are components for the formation of MnSe. Firstly, Mn is required to be at least 0.02% for developing the function as an inhibitor, while when the Mn amount exceeds 0.15%, the solid solution temperature of MnSe becomes too high and hence the solid solution is not carried out at the usual slab heating temperature and the magnetic properties are degraded, so that the Mn amount is limited to a range of 0.02–0.15%. Secondly, when the Se amount exceeds 0.060%, the purification in the purification annealing is difficult, while when it is less than 0.010%, the inhibitor amount is lacking, so that the Se amount is limited to a range of 0.010–0.060%.

Sb: 0.01–0.20%

Sb serves as a grain boundary segregation type inhibitor. When the Sb amount is less than 0.01%, the effect as the inhibitor is poor while when it exceeds 0.20%, Sb badly affects the decarburization property and the formation of the surface coating layer, so that the Sb amount is limited to a range of 0.01–0.20%.

Cu: 0.02–0.30%

Cu is a useful element forming $Cu_{2-x}Se$ as an inhibitor. When the Cu amount is less than 0.02%, the addition effect is poor, while when it exceeds 0.30%, the toughness is degraded, so that the Cu amount is limited to a range of 0.02–0.30%.

Although the invention is described with respect to the basic components, the following elements may properly be added in the invention.

Mo: 0.005–0.05%

Mo effectively contributes to improve the surface properties. When the Mo amount is less than 0.005%, the addition effect is poor, while when it exceeds 0.05%, the decarburization property is degraded, so that the Mo amount is preferably within a range of 0.005–0.05%.

Sn 0.02–0.30%

Sn is an element useful for refining of the secondary recrystallized grains to improve the iron loss value. When the Sn amount is less than 0.02%, the addition effect is poor, while when it exceeds 0.30%, the decarburization property is degraded, so that the Sn amount is preferably within a range of 0.02–0.30%.

Ge: 0.005–0.50%

Ge is an element useful for refining of the secondary recrystallized grains to improve the iron loss value likewise Sn. When the Ge amount is less than 0.005%, the addition effect is poor, while when it exceeds 0.50%, the toughness is degraded, so that the Ge amount is preferably within a range of 0.005–0.50%.

In the invention, a slab of silicon steel having the above chemical composition is heated and hot rolled according to the usual manner. Thereafter, the hot rolled sheet is subjected to a normalizing annealing at a temperature of about 900°–1050° C., if necessary, for the stabilization of magnetic properties, and then subjected to a heavy cold rolling or two-stage cold rolling through an intermediate annealing up to a final product thickness.

After the cold rolling, the sheet is subjected to a decarburization annealing. The first invention lies in the condition of such a decarburization annealing.

That is, the decarburization annealing is carried out in such a manner that the sheet is heated to a temperature range of 850°–1000° C. at a temperature rising rate of not less than 10° C./s and kept a this temperature range in a non-oxidizing atmosphere having a dew point of not higher than 15° C. for a time of from 5 seconds to 60 seconds and further kept in a wet hydrogen atmosphere of 780°–850° C.

When the temperature rising rate is less than 10° C./s, the ratio of Goss texture in the primary recrystallized texture is decreased to degrade the magnetic properties, so that the temperature rising rate is limited to not less than 10° C./s. Furthermore, when the annealing temperature in the first half of the decarburization annealing is lower than 850° C., the ratio of Goss texture in the primary recrystallized texture is decreased to degrade the magnetic properties, while when it exceeds 1000° C., even if Cu is added, the Ostwald growth of the inhibitor is caused to lose the reinhibitation effect and degrade the magnetic properties, so that the sheet is soaked at a temperature of 850°–1000° C. Moreover, when the keeping time at a temperature of 850°–1000° C. is less than 5 seconds, the formation of the texture is insufficient and the magnetic properties are degraded, while when it exceeds 60 seconds, the Ostwald growth of the inhibitor is caused to lose the reinhibitation effect and degrade the magnetic properties, so that the time is limited to not less than 5 seconds but not more than 60 seconds. The annealing atmosphere kept at the temperature of 850°–1000° C. is a non-oxidizing atmosphere having a dew point of not higher than 15° C. The term "non-oxidizing atmosphere" used herein means a neutral atmosphere of $N_2$, Ar or the like, or a reducing atmosphere of $H_2$ or the like. When the dew point is higher than 15° C., the decarburization is poor and the magnetic properties are degraded, so that the dew point is limited to not higher than 15° C.

As to the keeping temperature at the last half of the decarburization treatment, when it is lower than 780° C. or higher than 850° C., the decarburization is poor and the magnetic properties are degraded, so that it is limited to a range of 780°–850° C. The atmosphere in the last half is a wet hydrogen atmosphere for conducting the decarburization. Furthermore, the keeping time at 780°–850° C. is not less than 30 seconds but not more than 5 minutes because when it is less than 30 seconds, the decarburization is poor and the magnetic properties are degraded, while when it exceeds 5 minutes, the good glass film is not formed. After the decarburization annealing, the sheet is coated with a slurry of an annealing separator consisting mainly of MgO, and then subjected to a secondary recrystallization annealing at a temperature of about 850° C. and further to a purification annealing in $H_2$ atmosphere of about 1200° C.

In the second invention, the final product thickness is limited to a range of 0.12–0.23 mm because when it is less than 0.12 mm, the secondary recrystallization is poor, while when it exceeds 0.23 mm, the eddy current loss increases and the good iron loss value is not obtained.

After the above cold rolling and decarburization annealing, the slurry of the annealing separator consisting mainly of MgO is applied and dried and then the secondary recrystallization annealing and purification annealing are conducted.

In this case, the secondary recrystallization annealing is a treatment that the sheet is heated up to a certain temperature of 840°–900° C. at a temperature rising rate of not less than 15° C./h and kept at this temperature in a mixed atmosphere of Ar and $N_2$ for 30 minutes to 5 hours and further kept at a certain temperature lower by 20°–50° C. than the above temperature for not less than 20 hours. The reason why the keeping temperature in the initial keeping treatment of the secondary recrystallization annealing (primary keeping treatment) is limited to a range of 840°–900° C. is due to the fact that when the keeping temperature is lower than 840° C., the precipitation amount of $Cu_{2-x}Se$ is not sufficiently increased and the improvement of the magnetic properties can not be expected, while when it exceeds 900° C., the precipitates such as previously precipitated $Cu_{2-x}Se$ and the like too grow to lose the function as the inhibitor. Furthermore, when the temperature rising rate up to a certain temperature of 840°–900° C. is less than 15° C./h, the precipitates of $Cu_{2-x}Se$ and the like grow during the temperature rising to lose the function as an inhibitor, so that the temperature rising rate is limited to not less than 15° C./h. When the keeping time in the primary keeping treatment is less than 30 minutes, the increase of the $Cu_{2-x}Se$ precipitated amount is insufficient and the magnetic properties are not improved, while when it exceeds 5 hours, the precipitates of $Cu_{2-x}Se$ and the like too grow to lose the function as an inhibitor, so that the keeping time is limited to a range of 30 minutes to 5 hours. Moreover, a preferable mixing ratio of Ar in the mixed atmosphere for the primary keeping treatment is about 20–80%.

Subsequently, a secondary keeping treatment is carried out at a temperature lower than the primary keeping temperature. In this secondary keeping treatment, when the difference of the keeping temperature to the primary keeping temperature is lower than 20° C., secondary grains of undesirable orientation grow to cause the degradation of the magnetic flux density, while when it exceeds 50° C., the growth of secondary recrystallized grain is insufficient and the magnetic properties are degraded, so that the secondary keeping treatment is carried out at a temperature lower by 20°-50° C. than the primary keeping temperature. In this case, when the secondary keeping time is less than 20 hours, the growth of the secondary recrystallized grain is insufficient and the magnetic properties are degraded, so that it is limited to not less than 20 hours. Moreover, the upper limit of the keeping time is not particularly restricted, but it is about 50 hours in industry.

In the third invention, the annealing separator consisting mainly of MgO is added with 1-50 parts by weight as $Al_2O_3$ of a spinel type composite oxide containing aluminum and 1-20 parts by weight as $TiO_2$ of a Ti compound based on 100 parts by weight of MgO.

When the compounding amount of the spinel type composite oxide containing aluminum is less than 1 part by weight as $Al_2O_3$ based on 100 parts by weight of MgO in the annealing separator, the effect of preventing the penetration of Ti into steel is insufficient, while when it exceeds 50 parts by weight, the formation of forsterite layer (or glass film) is obstructed, so that the compounding amount as $Al_2O_3$ of the spinel type composite oxide is limited to 1-50 parts by weight. On the other hand, when the compounding amount of the Ti compound is less than 1 part by weight as $TiO_2$, the homogeneity and adhesion property of the forsterite layer are degraded, while when it exceeds 20 parts by weight, the adhesion property of the forsterite layer is degraded, so that the compounding amount as $TiO_2$ of the Ti compound is limited to a range of 1-20 parts by weight.

The spinel type composite oxide containing aluminum is represented by a chemical formula of R—$Al_2O_4$ (wherein R is Mn, Mg, Zn, Fe or the like). When such an oxide is added to the annealing separator, if the grain size is too large, the effect lowers, so that it is desirable to be about 2 μm on average.

As the Ti compound, use may be made of $TiO_2$, TiO, $Ti_2O_3$, $Ti(OH)_4$ and various Ti salts such as $CaTiO_3$, $SrTiO_3$, $MgTiO_3$, $BaTiO_3$, $BaTiO_4$, $MnTiO_3$, $FeTiO_3$ and the like.

The following examples are given in illustration of the invention and are not intended as limitations thereof.

EXAMPLE 1

A slab of silicon steel comprising C: 0.040%, Si: 3.35%, Mn: 0.070%, Se: 0.021%, Sb: 0.024%, Cu: 0.10% and the balance being substantially Fe was heated to 1430° C. and hot rolled to a thickness of 2.0 mm. Then, the hot rolled sheet was subjected to a first cold rolling to a middle thickness of 0.49 mm, an intermediate annealing at 975° C. for 60 seconds and a second cold rolling to a final product thickness of 0.20 mm. Thereafter, the cold rolled sheet was subjected to a decarburization annealing under conditions as shown in Table 1.

Then, the sheet was coated with a slurry of an annealing separator of MgO containing 1.5% of $TiO_2$ and subjected to a secondary recrystallization annealing at 850° C. for 50 hours and a purification annealing in $H_2$ atmosphere t 1200° C. for 10 hours.

The magnetic properties of the thus obtained product sheets were measured to obtain results as shown in Table 1.

TABLE 1

| | Temperature rising rate (°C./s) | Primary soaking temperature (°C.) | Primary soaking time (s) | Primary soaking dew point (°C.) | Secondary soaking temperature (°C.) | Secondary soaking time (s) | Iron loss $W_{17/59}$ (W/kg) | Magnetic flux density $B_8$ (T) | Remarks |
|---|---|---|---|---|---|---|---|---|---|
| 1 | 20 | 900 | 20 | −20 | 820 | 90 | 0.78 | 1.912 | Acceptable example |
| 2 | 35 | 900 | 20 | −20 | 820 | 90 | 0.78 | 1.916 | Acceptable example |
| 3 | 20 | 950 | 20 | −20 | 820 | 90 | 0.79 | 1.914 | Acceptable example |
| 4 | 20 | 900 | 10 | −20 | 820 | 90 | 0.79 | 1.915 | Acceptable example |
| 5 | 10 | 900 | 20 | −20 | 820 | 90 | 0.78 | 1.917 | Acceptable example |
| 6 | 5 | 900 | 20 | −20 | 820 | 90 | 0.85 | 1.901 | Comparative example |
| 7 | 20 | 840 | 20 | −20 | 820 | 90 | 0.84 | 1.895 | Comparative example |
| 8 | 20 | 1050 | 20 | −20 | 820 | 90 | 0.96 | 1.875 | Comparative example |
| 9 | 20 | 900 | 3 | −20 | 820 | 90 | 0.85 | 1.896 | Comparative example |
| 10 | 20 | 900 | 70 | −20 | 820 | 90 | 0.88 | 1.885 | Comparative example |
| 11 | 20 | 900 | 20 | 20 | 820 | 90 | 0.92 | 1.872 | Comparative example |
| 12 | 20 | 900 | 20 | −20 | 880 | 90 | 0.94 | 1.870 | Comparative example |
| 13 | 20 | 900 | 20 | −20 | 750 | 90 | 0.95 | 1.867 | Comparative example |
| 14 | 20 | 900 | 20 | −20 | 820 | 20 | 0.94 | 1.871 | Comparative example |
| 15 | 8 | 900 | 20 | −20 | 820 | 90 | 0.88 | 1.897 | Comparative example |

EXAMPLE 2

A slab of silicon steel having a chemical composition as shown in Table 2 was heated to 1425° C. and hot rolled to a thickness of 1.8 mm. Then, the hot rolled sheet was subjected to a first cold rolling to a middle thickness of 0.47 mm, an intermediate annealing at 1000° C. for 30 seconds and a second cold rolling to a final product thickness of 0.20 mm. Thereafter, the cold rolled sheet was subjected to a decarburization annealing under such a condition that the sheet was heated at a temperature rising rate of 20° C./s and kept at 900° C. in $N_2$ atmosphere having a dew point of −30° C. for 20 seconds and further kept at 820° C. in $H_2$ atmosphere having a dew point of 60° C. for 90 seconds. After a slurry of an annealing separator of MgO containing 3% of TiO was applied, the sheet was subjected to a secondary recrystallization annealing at 850° C. for 50 hours and further to a purification annealing in $H_2$ atmosphere at 1200° C. for 10 hours.

The magnetic properties of the thus obtained product sheets were measured to obtain results as shown in Table 2.

TABLE 2

| | C | Si | Mn | Se | Sb | Cu | Mo | Sn | Ge | Iron loss $W_{17/50}$ (W/kg) | Magnetic flux density $B_8$ (T) |
|---|---|---|---|---|---|---|---|---|---|---|---|
| 1 | 0.039 | 3.25 | 0.068 | 0.020 | 0.025 | 0.12 | tr | tr | tr | 0.80 | 1.913 |
| 2 | 0.040 | 3.29 | 0.065 | 0.022 | 0.025 | 0.11 | 0.02 | 0.01 | tr | 0.80 | 1.911 |
| 3 | 0.041 | 3.39 | 0.066 | 0.023 | 0.023 | 0.11 | tr | 0.15 | tr | 0.77 | 1.911 |
| 4 | 0.037 | 3.35 | 0.070 | 0.021 | 0.027 | 0.12 | tr | tr | 0.05 | 0.79 | 1.919 |
| 5 | 0.035 | 3.31 | 0.067 | 0.020 | 0.025 | 0.08 | 0.02 | 0.11 | tr | 0.78 | 1.913 |
| 6 | 0.036 | 3.33 | 0.071 | 0.019 | 0.022 | 0.09 | 0.02 | tr | 0.06 | 0.79 | 1.917 |
| 7 | 0.039 | 3.34 | 0.068 | 0.021 | 0.025 | 0.10 | tr | 0.13 | 0.07 | 0.77 | 1.916 |
| 8 | 0.039 | 3.36 | 0.072 | 0.020 | 0.025 | 0.11 | 0.02 | 0.12 | 0.08 | 0.77 | 1.918 |

EXAMPLE 3

A slab of silicon steel comprising C: 0.042%, Si: 3.45%, Mn: 0.073%, Se: 0.020%, Sb: 0.026%, Cu: 0.12% and the balance being substantially Fe was heated to 1420° C. and hot rolled to a thickness of 2.0 mm. Then, the hot rolled sheet was subjected to a first cold rolling to a middle thickness of 0.48 mm, an intermediate annealing at 1000° C. for 90 seconds and a second cold rolling to a final product thickness of 0.18 mm.

Figure 4:
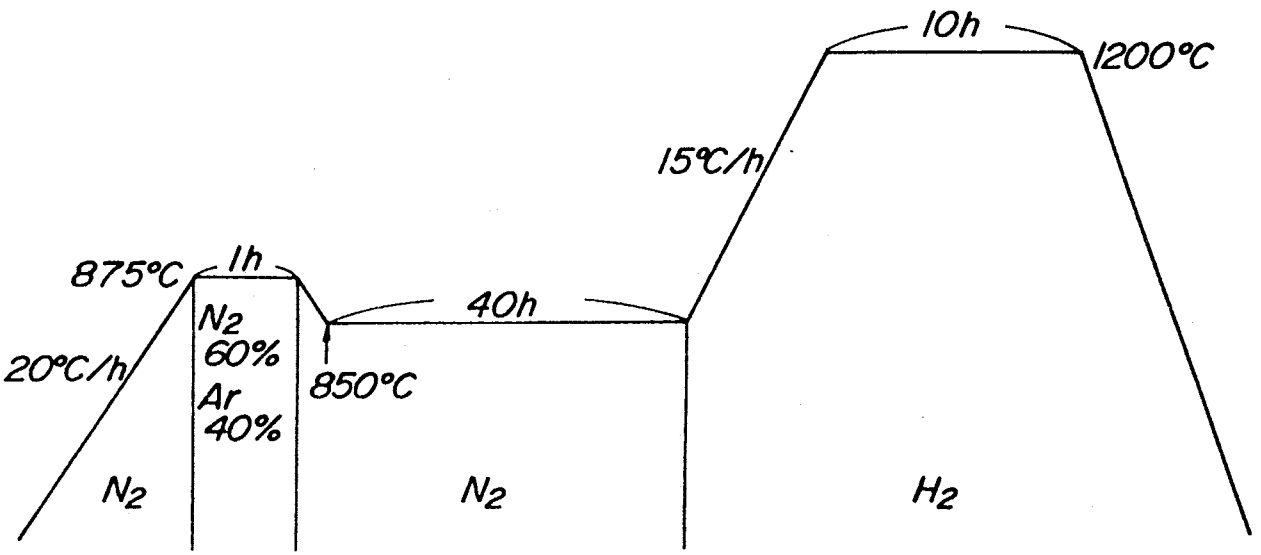
FIGS. 4 to 7 are schematic views showing a final finish annealing (i.e. secondary recrystallization annealing and subsequent purification annealing) pattern in various embodiments according to the invention, respectively.

Thereafter, the cold rolled sheet was subjected to a decarburization annealing in wet $H_2$ atmosphere at 820° C. for 2 minutes, coated with a slurry of an annealing separator of MgO containing 3.0% of $TiO_2$, and then subjected to a final finish annealing according to a temperature pattern shown in FIG. 4.

The magnetic properties of the thus obtained product sheets were measured to obtain results as shown in Table 3.

TABLE 3

| | Temperature rising rate (°C./s) | Primary keeping temperature (°C.) | Primary keeping time (h) | Atmosphere in primary keeping | Secondary keeping temperature (°C.) | Secondary keeping time (s) | Iron loss $W_{17/59}$ (W/kg) | Magnetic flux density $B_8$ (T) | Remarks |
|---|---|---|---|---|---|---|---|---|---|
| 1 | 25 | 880 | 2 | $N_2$ 25% Ar 75% | 850 | 35 | 0.77 | 1.932 | Acceptable example |
| 2 | 25 | 880 | 2 | $N_2$ 25% Ar 75% | 840 | 50 | 0.76 | 1.928 | Acceptable example |
| 3 | 25 | 880 | 4 | $N_2$ 25% Ar 75% | 850 | 35 | 0.78 | 1.936 | Acceptable example |
| 4 | 25 | 860 | 2 | $N_2$ 25% Ar 75% | 830 | 50 | 0.78 | 1.929 | Acceptable example |
| 5 | 25 | 880 | 2 | $N_2$ 50% Ar 50% | 850 | 35 | 0.79 | 1.927 | Acceptable example |
| 6 | 10 | 880 | 2 | $N_2$ 25% Ar 75% | 850 | 35 | 0.85 | 1.911 | Comparative example |
| 7 | 25 | 920 | 2 | $N_2$ 25% Ar 75% | 850 | 35 | 0.92 | 1.882 | Comparative example |
| 8 | 25 | 830 | 2 | $N_2$ 25% Ar 75% | 850 | 35 | 0.91 | 1.876 | Comparative example |
| 9 | 25 | 880 | 10 | $N_2$ 25% Ar 75% | 850 | 35 | 0.86 | 1.909 | Comparative example |
| 10 | 25 | 880 | 0.2 | $N_2$ 25% Ar 75% | 850 | 35 | 0.88 | 1.905 | Comparative example |
| 11 | 25 | 880 | 2 | $N_2$ | 850 | 35 | 0.86 | 1.910 | Comparative example |
| 12 | 25 | 880 | 2 | Ar | 850 | 35 | 0.85 | 1.912 | Comparative example |
| 13 | 25 | 880 | 2 | $N_2$ 25% Ar 75% | 870 | 35 | 0.89 | 1.906 | Comparative example |
| 14 | 25 | 880 | 2 | $N_2$ 25% Ar 75% | 820 | 35 | 0.93 | 1.890 | Comparative example |
| 15 | 25 | 880 | 2 | $N_2$ 25% Ar 75% | 850 | 10 | 0.97 | 1.872 | Comparative example |

EXAMPLE 4

A slab of silicon steel comprising C: 0.040%, Si: 3.45%, Mn: 0.070%, Se: 0.020%, Sb: 0.023%, Cu:

0.10%, Mo: 0.010% and the balance being substantially Fe was heated to 1420° C. and hot rolled to a thickness of 1.4–2.4 mm. Then, the hot rolled sheet was subjected to a first cold rolling to a middle thickness as shown in Table 4, an intermediate annealing at 1000° C. for 90 seconds and a second cold rolling to a final product thickness as shown in Table 4.

Figure 5:
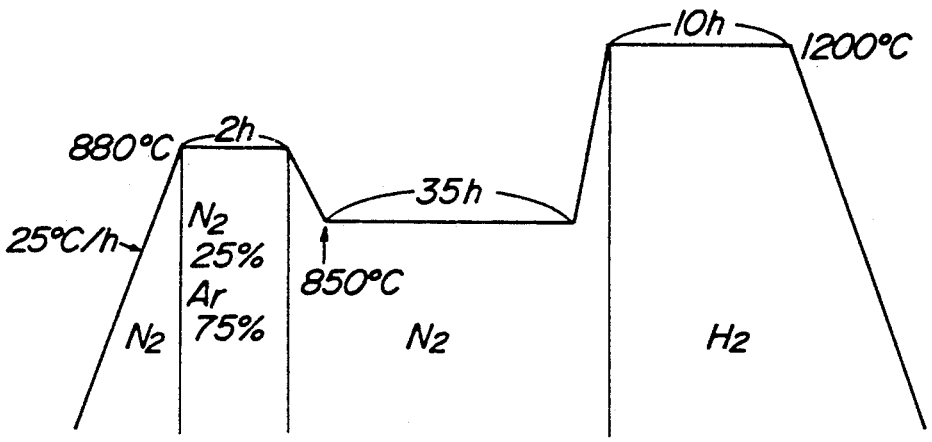

Thereafter, the cold rolled sheet was subjected to a decarburization annealing in wet $H_2$ atmosphere at 820° C. for 2 minutes, coated with a slurry of an annealing separator of MgO containing 3.0% of $TiO_2$, and then subjected to a final finish annealing according to a temperature pattern shown in FIG. 5.

The magnetic properties of the thus obtained product sheets were measured to obtain results as shown in Table 4.

Table 4.

TABLE 4

| | Thickness in hot rolling (mm) | Middle thickness (mm) | Final thickness (mm) | Iron Loss $W_{17/50}$ (W/kg) | Magnetic flux density $B_8$ (T) | Remarks |
|---|---|---|---|---|---|---|
| 1 | 2.0 | 0.61 | 0.23 | 0.81 | 1.939 | Acceptable example |
| 2 | 1.8 | 0.48 | 0.20 | 0.79 | 1.935 | Acceptable example |
| 3 | 1.8 | 0.45 | 0.18 | 0.76 | 1.930 | Acceptable example |
| 4 | 1.6 | 0.38 | 0.16 | 0.73 | 1.926 | Acceptable example |
| 5 | 1.6 | 0.35 | 0.13 | 0.74 | 1.912 | Acceptable example |
| 6 | 1.4 | 0.32 | 0.10 | 0.86 | 1.873 | Comparative example |
| 7 | 2.4 | 0.82 | 0.30 | 0.96 | 1.938 | Comparative example |

EXAMPLE 5

A slab of silicon steel having a chemical composition as shown in Table 5 was heated to 1420° C. and hot rolled to a thickness of 2.0 mm. Then, the hot rolled sheet was subjected to a normalizing annealing at 1000° C. for 1 minute, a first cold rolling to a middle thickness of 0.52 mm, an intermediate annealing at 950° C. for 90 seconds and a second cold rolling to a final product thickness of 0.20 mm. Thereafter, the cold rolled sheet was subjected to a decarburization annealing in wet $H_2$ atmosphere at 820° C. for 2 minutes, coated with a slurry of an annealing separator comprising 2% of $TiO_2$ and the reminder of MgO, and then subjected to a final finish annealing according to a temperature pattern shown in FIG. 5.

The magnetic properties of the thus obtained product sheets were measured to obtain results as shown in Table 5.

TABLE 5

| | Chemical composition (%) | | | | | | | | | Iron loss | Magnetic flux density |
|---|---|---|---|---|---|---|---|---|---|---|---|
| | C | Si | Mn | Se | Sb | Cu | Mo | Sn | Ge | $W_{17/50}$ (W/kg) | $B_8$ (T) |
| 1 | 0.041 | 3.34 | 0.068 | 0.019 | 0.022 | 0.22 | tr | tr | tr | 0.78 | 1.923 |
| 2 | 0.036 | 3.29 | 0.071 | 0.021 | 0.025 | 0.25 | tr | 0.13 | tr | 0.76 | 1.920 |
| 3 | 0.039 | 3.32 | 0.070 | 0.018 | 0.020 | 0.15 | 0.01 | 0.01 | 0.01 | 0.77 | 1.921 |
| 4 | 0.042 | 3.30 | 0.067 | 0.022 | 0.026 | 0.18 | tr | tr | 0.02 | 0.76 | 1.923 |
| 5 | 0.040 | 3.33 | 0.073 | 0.020 | 0.023 | 0.12 | 0.02 | 0.15 | tr | 0.78 | 1.922 |
| 6 | 0.038 | 3.28 | 0.075 | 0.019 | 0.027 | 0.23 | 0.02 | tr | 0.01 | 0.77 | 1.925 |
| 7 | 0.040 | 3.26 | 0.069 | 0.021 | 0.025 | 0.13 | tr | 0.20 | 0.01 | 0.77 | 1.920 |

EXAMPLE 6

A slab of silicon steel comprising C: 0.045%, Si: 3.40%, Mn: 0.071%, Se: 0.021%, Sb: 0.025%, Cu: 0.10% and the balance being substantially Fe was heated to 1420° C. and hot rolled to a thickness of 2.0 mm. Then, the hot rolled sheet was subjected to a first cold rolling to a middle thickness of 0.52 mm, an intermediate annealing at 950° C. for 90 seconds and a second cold rolling to a final product thickness of 0.20 mm. Thereafter, the cold rolled sheet was subjected to a decarburization annealing in wet $H_2$ atmosphere at 820° C. for 2 minutes and coated with a slurry of an annealing separator having a composition as shown in Table 6. As the spinel type composite oxide, magnesia spinel ($MgAl_2O_4$) was used, and $TiO_2$ was used as the Ti compound.

Figure 6:
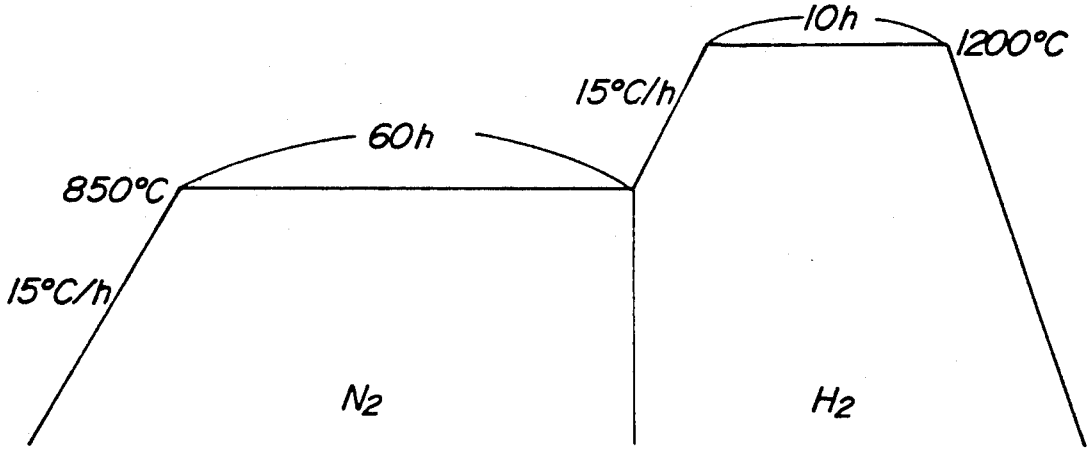

Then, the sheet was subjected to a final finish annealing according to a temperature pattern as shown in FIG. 6.

The magnetic properties and coated appearance of the thus obtained product sheets were measured to obtain results as shown in Table 6.

TABLE 6

| No. | Content in annealing separator (%) $TiO_2$ | spinel | Temperature rising rate (°C./h) | Primary keeping temperature (°C.) | Primary keeping time (h) | Secondary keeping temperature (°C.) | Secondary keeping time (h) | Iron loss ($W_{17/50}$) (W/kg) | Magnetic flux density $B_8$ (T) | Glass film appearance | Remarks |
|---|---|---|---|---|---|---|---|---|---|---|---|
| 1 | 5.0 | 10 | 25 | 870 | 1 | 840 | 35 | 0.81 | 1.925 | good | Acceptable example |
| 2 | 5.0 | 10 | 25 | 870 | 1 | 830 | 50 | 0.80 | 1.923 | good | Acceptable example |
| 3 | 5.0 | 10 | 25 | 870 | 3 | 840 | 35 | 0.82 | 1.926 | good | Acceptable example |
| 4 | 10.0 | 15 | 25 | 870 | 1 | 840 | 35 | 0.80 | 1.925 | good | Acceptable example |
| 5 | 0 | 0 | 25 | 870 | 1 | 840 | 35 | 0.83 | 1.923 | ununiform | Comparative example |
| 6 | 0 | 10 | 25 | 870 | 1 | 840 | 35 | 0.84 | 1.919 | ununiform | Comparative example |
| 7 | 5.0 | 0 | 25 | 870 | 1 | 840 | 35 | 0.92 | 1.905 | good | Comparative example |
| 8 | 25.0 | 10 | 25 | 870 | 1 | 840 | 35 | 0.90 | 1.905 | ununiform | Comparative |

TABLE 6-continued

| No. | Content in annealing separator (%) $TiO_2$ | spinel | Temperature rising rate (°C./h) | Primary keeping temperature (°C.) | Primary keeping time (h) | Secondary keeping temperature (°C.) | Secondary keeping time (h) | Iron loss ($W_{17/50}$) (W/kg) | Magnetic flux density $B_8$ (T) | Glass film appearance | Remarks |
|---|---|---|---|---|---|---|---|---|---|---|---|
| | | | | | | | | | | | example |
| 9 | 5.0 | 60 | 25 | 870 | 1 | 840 | 35 | 0.87 | 1.915 | ununiform | Comparative example |
| 10 | 5.0 | 10 | 10 | 870 | 1 | 840 | 35 | 0.89 | 1.909 | good | Comparative example |
| 11 | 5.0 | 10 | 25 | 920 | 1 | 840 | 35 | 0.95 | 1.893 | good | Comparative example |
| 12 | 5.0 | 10 | 25 | 830 | 1 | 840 | 35 | 0.93 | 1.886 | good | Comparative example |
| 13 | 5.0 | 10 | 25 | 870 | 10 | 840 | 35 | 0.91 | 1.899 | good | Comparative example |
| 14 | 5.0 | 10 | 25 | 870 | 0.2 | 840 | 35 | 0.89 | 1.904 | good | Comparative example |
| 15 | 5.0 | 10 | 25 | 870 | 1 | 870 | 35 | 0.97 | 1.879 | good | Comparative example |
| 16 | 5.0 | 10 | 25 | 870 | 1 | 810 | 35 | 0.90 | 1.900 | good | Comparative example |
| 17 | 5.0 | 10 | 25 | 870 | 1 | 870 | 10 | 0.93 | 1.895 | good | Comparative example |

EXAMPLE 7

A slab of silicon steel comprising C: 0.041%, Si: 3.39%, Mn: 0.076%, Se: 0.020%, Sb: 0.025%, Cu: 0.11%, Mo: 0.010% and the balance being substantially Fe was heated to 1420° C. and hot rolled to a thickness of 1.4–2.4 mm. Then, the hot rolled sheet was subjected to a first cold rolling to a middle thickness as shown in Table 7, an intermediate annealing at 950° C. for 90 seconds and a second cold rolling to a final product thickness as shown in Table 7. Thereafter, the cold rolled sheet was subjected to a decarburization annealing in wet $H_2$ atmosphere at 850° C. for 2 minutes, coated with a slurry of an annealing separator containing 10 parts by weight of magnesia spinel ($MgAl_2O_4$) and 5 parts by weight of $TiO_2$ based on 100 parts by weight of MgO, and then subjected to a final finish annealing according to a temperature pattern as shown in FIG. 6.

The magnetic properties of the thus obtained product sheets were measured to obtain results as shown in Table 7.

TABLE 7

| | Thickness in hot rolling (mm) | Middle thickness (mm) | Final thickness (mm) | Iron loss $W_{17/50}$ (W/kg) | Magnetic flux density $B_8$ (T) | Remarks |
|---|---|---|---|---|---|---|
| 1 | 2.0 | 0.62 | 0.23 | 0.83 | 1.928 | Acceptable example |
| 2 | 1.8 | 0.52 | 0.20 | 0.80 | 1.927 | Acceptable example |
| 3 | 1.8 | 0.48 | 0.18 | 0.77 | 1.923 | Acceptable example |
| 4 | 1.6 | 0.43 | 0.15 | 0.75 | 1.920 | Acceptable example |

TABLE 7-continued

| | Thickness in hot rolling (mm) | Middle thickness (mm) | Final thickness (mm) | Iron loss $W_{17/50}$ (W/kg) | Magnetic flux density $B_8$ (T) | Remarks |
|---|---|---|---|---|---|---|
| 5 | 1.6 | 0.39 | 0.13 | 0.74 | 1.915 | Acceptable example |
| 6 | 1.4 | 0.34 | 0.10 | 0.86 | 1.865 | Comparative example |
| 7 | 2.4 | 0.84 | 0.30 | 0.99 | 1.931 | Comparative example |

EXAMPLE 8

A slab of silicon steel having a chemical composition as shown in Table 8 was heated to 1430° C. and hot rolled to a thickness of 1.8 mm. Then, the hot rolled sheet was subjected to a normalized annealing at 1000° C. for 1 minute, a first cold rolling to a middle thickness of 0.50 mm, an intermediate annealing at 975° C. for 1 minute and a second cold rolling to a final product thickness of 0.20 mm. Thereafter, the cold rolled sheet was subjected to a decarburization in wet $H_2$ atmosphere at 850° C. for 2 minutes, coated with a slurry of an annealing separator containing 20 parts by weight of magnesia spinel ($MgAl_2O_4$) and 3 parts by weight of $TiO_2$ based on 100 parts by weight of MgO, and then subjected to a final finish annealing according to a temperature pattern as shown in FIG. 6.

The magnetic properties of the thus obtained product sheets were measured to obtain results as shown in Table 8.

TABLE 8

| | Chemical composition (%) C | Si | Mn | Se | Sb | Cu | Mo | Sn | Ge | Iron loss $W_{17/50}$ (W/kg) | Magnetic flux density $B_8$ (T) |
|---|---|---|---|---|---|---|---|---|---|---|---|
| 1 | 0.039 | 3.30 | 0.065 | 0.018 | 0.025 | 0.12 | tr | tr | tr | 0.79 | 1.915 |
| 2 | 0.037 | 3.25 | 0.070 | 0.020 | 0.022 | 0.18 | 0.02 | tr | tr | 0.78 | 1.917 |
| 3 | 0.041 | 3.37 | 0.068 | 0.021 | 0.018 | 0.25 | 0.02 | tr | 0.01 | 0.79 | 1.914 |
| 4 | 0.042 | 3.31 | 0.072 | 0.022 | 0.026 | 0.15 | 0.01 | 0.08 | tr | 0.77 | 1.915 |
| 5 | 0.038 | 3.27 | 0.069 | 0.020 | 0.024 | 0.17 | tr | 0.15 | tr | 0.77 | 1.916 |
| 6 | 0.040 | 3.28 | 0.070 | 0.021 | 0.030 | 0.21 | tr | tr | 0.02 | 0.76 | 1.917 |
| 7 | 0.036 | 3.31 | 0.066 | 0.018 | 0.021 | 0.12 | 0.01 | 0.13 | 0.01 | 0.78 | 1.917 |

EXAMPLE 9

A slab of silicon steel comprising C: 0.036%, Si: 3.33% Mn: 0.068%, Se: 0.020%, Sb: 0.025%, Cu: 0.15% and the balance being substantially Fe was heated to 1430° C. and hot rolled to a thickness of 2.0 mm. Then, the hot rolled sheet was subjected to a normalizing annealing at 975° C. for 1 minute, a first cold rolling to a middle thickness of 0.50 mm, an intermediate annealing at 1000° C. for 1 minute and a second cold rolling to a final product thickness of 0.20 mm.

Thereafter, the cold rolled sheet was subjected to a decarburization annealing by heating at a temperature rising rate of 15° C./s and then treating under various conditions as shown in Table 9.

After the application of a slurry of an annealing separator consisting mainly of MgO, the sheet was subjected to a secondary recrystallization annealing by heating at a temperature rising rate of 25° C./h, and then treating under conditions as shown in Table 9 and further to a purification annealing in $H_2$ atmosphere at 1200° C. for 5 hours.

After the application of a slurry of an annealing separator of MgO containing 2% of $TiO_2$, the sheet was subjected to a final finish annealing according to a temperature pattern as shown in FIG. 5.

The magnetic properties of the thus obtained product sheets were measured to obtain results as shown in Table 10.

TABLE 10

| | Thickness in hot rolling (mm) | Middle thickness (mm) | Final thickness (mm) | Iron Loss $W_{17/50}$ (W/kg) | Magnetic flux density $B_8$ (T) |
|---|---|---|---|---|---|
| 1 | 2.0 | 0.60 | 0.23 | 0.80 | 1.935 |
| 2 | 1.8 | 0.48 | 0.20 | 0.76 | 1.936 |
| 3 | 1.8 | 0.45 | 0.18 | 0.75 | 1.932 |
| 4 | 1.6 | 0.38 | 0.16 | 0.71 | 1.928 |
| 5 | 1.6 | 0.35 | 0.13 | 0.70 | 1.920 |

EXAMPLE 11

A slab of silicon steel having a chemical composition as shown in Table 11 was heated to 1430° C. and hot rolled to a thickness of 1.8 mm. Then, the hot rolled sheet was subjected to a normalizing annealing at 1000° C. for 1 minute, a first cold rolling to a middle thickness of 0.50 mm, an intermediate annealing at 975° C. for 1 minute and a second cold rolling to a final product thickness of 0.20 mm.

Thereafter, the cold rolled sheet was subjected to a decarburization annealing by heating at a temperature rising rate of 20° C./s and then keeping at 865° C. in an atmosphere having a dew point of 5° C. for 10 seconds and further at 825° C. in $H_2$ atmosphere having a dew point of 55° C. for 90 seconds.

After the application of a slurry of an annealing separator of MgO containing 1.5% of $TiO_2$, the sheet was subjected to a final finish annealing according to a temperature pattern as shown in FIG. 5.

The magnetic properties of the thus obtained product sheets were measured to obtain results as shown in Table 11.

TABLE 9

| | Decarburization annealing | | Secondary recrystallization annealing | | | |
|---|---|---|---|---|---|---|
| | Primary soaking temperature (°C.) time (s) dew point (°C.) | Secondary soaking temperature (°C.) time (s) dew point (°C.) | Primary keeping temperature (°C.) time (h) atmosphere | Secondary keeping temperature (°C.) time (h) atmosphere | Iron loss $W_{17/50}$ (W/kg) | Magnetic flux density $B_8$ (T) |
| 1 | 850<br>120<br>60 | | 860<br>1<br>$N_2$ 70%<br>Ar 30% | 840<br>50<br>$N_2$ 100% | 0.79 | 1.928 |
| 2 | 860<br>20<br>10 | 830<br>100<br>55 | 850<br>50<br>$N_2$ 100% | | 0.80<br>0.80 | 1.912<br>1.912 |
| 3 | 860<br>20<br>10 | 830<br>100<br>55 | 860<br>1<br>$N_2$ 70%<br>Ar 30% | 840<br>50<br>$N_2$ 100% | 0.76 | 1.929 |
| 4 | 880<br>30<br>0 | 840<br>80<br>62 | 870<br>2<br>$N_2$ 80%<br>Ar 20% | 845<br>50<br>$N_2$ 100% | 0.75 | 1.932 |
| 5 | 900<br>10<br>−20 | 820<br>90<br>65 | 865<br>1<br>$N_2$ 50%<br>Ar 50% | 845<br>60<br>$N_2$ 100% | 0.77 | 1.928 |
| 6 | 865<br>15<br>15 | 825<br>90<br>60 | 870<br>1<br>$N_2$ 90%<br>Ar 10% | 850<br>45<br>$N_2$ 100% | 0.76 | 1.931 |

EXAMPLE 10

A slab of silicon steel comprising C: 0.038%, Si: 3.35% Mn: 0.068%, Se: 0.020%, Sb: 0.027%, Cu: 0.18%, Mo: 0.012% and the balance being substantially Fe was heated to 1420° C. and hot rolled to a thickness of 1.4–2.4 mm. Then, the hot rolled sheet was subjected to a normalizing annealing at 975° C. for 1 minute, a first cold rolling to a middle thickness as shown in Table 10, an intermediate annealing at 1000° C. for 90 seconds and a second cold rolling to a final product thickness as shown in Table 10.

Thereafter, the cold rolled sheet was subjected to a decarburization annealing by heating at a temperature rising rate of 15° C./s and then keeping at 850° C. in an atmosphere having a dew point of 10° C. for 15 seconds and further at 820° C. in $H_2$ atmosphere having a dew point of 60° C. for 80 seconds.

TABLE 11

| | Chemical composition (%) | | | | | | | | | Iron loss | Magnetic flux density |
|---|---|---|---|---|---|---|---|---|---|---|---|
| | C | Si | Mn | Se | Sb | Cu | Mo | Sn | Ge | $W_{17/50}$ (W/kg) | $B_8$ (T) |
| 1 | 0.038 | 3.32 | 0.068 | 0.020 | 0.027 | 0.23 | tr | tr | tr | 0.76 | 1.932 |
| 2 | 0.042 | 3.35 | 0.070 | 0.019 | 0.030 | 0.10 | 0.02 | tr | tr | 0.77 | 1.920 |
| 3 | 0.035 | 3.29 | 0.072 | 0.022 | 0.025 | 0.15 | 0.01 | 0.07 | tr | 0.76 | 1.925 |
| 4 | 0.044 | 3.27 | 0.072 | 0.021 | 0.022 | 0.12 | 0.02 | tr | 0.01 | 0.76 | 1.927 |
| 5 | 0.040 | 3.32 | 0.069 | 0.018 | 0.023 | 0.20 | 0.02 | 0.13 | 0.01 | 0.77 | 1.930 |
| 6 | 0.039 | 3.30 | 0.070 | 0.020 | 0.020 | 0.18 | tr | tr | 0.02 | 0.75 | 1.928 |
| 7 | 0.037 | 3.35 | 0.065 | 0.021 | 0.026 | 0.14 | tr | 0.15 | 0.02 | 0.76 | 1.925 |

EXAMPLE 12

A slab of silicon steel comprising C: 0.042%, Si: 3.33%, Mn: 0.070%, Se: 0.020%, Sb: 0.026%, Cu: 0.21% and the balance being substantially Fe was heated to 1420° C. and hot rolled to a thickness of 2.0 mm. Then, the hot rolled sheet was subjected to a first cold rolling to a middle thickness of 0.50 mm, an intermediate annealing at 950° C. for 90 seconds and a second cold rolling to a final product thickness of 0.20 mm.

Thereafter, the cold rolled sheet was subjected to a decarburization annealing by heating at a temperature rising rate of 15° C./s and then treating under various conditions as shown in Table 12.

After the application of a slurry of an annealing separator containing additives shown in Table 12 based on 100 parts by weight of MgO, the sheet was subjected to a secondary recrystallization annealing by heating at a temperature rising rate of 20° C./h and then treating under various conditions as shown in Table 12 and further to a purification annealing in $H_2$ atmosphere at 1200° C. for 5 hours.

The magnetic properties of the thus obtained product sheets were measured to obtain results as shown in Table 12.

TABLE 12

| | Decarburization annealing | | | Secondary recrystallization annealing | | | |
|---|---|---|---|---|---|---|---|
| | Primary soaking temperature (°C.) time (s) dew point (°C.) | Secondary soaking temperature (°C.) time (s) dew point (°C.) | Additive for annealing separator (part by weight) | Primary keeping temperature (°C.) time (h) atmosphere | Secondary keeping temperature (°C.) time (h) atmosphere | Iron loss $W_{17/50}$ (W/kg) | Magnetic flux density $B_8$ (T) |
| 1 | 855 | 825 | $MgAl_2O_4$:15 | 860 | 840 | 0.79 | 1.933 |
| | 20 | 80 | $TiO_2$:8 | 1 | 50 | | |
| 2 | 15 | 60 | $MnAl_2O_4$:20 | $N_2$ 80% | $N_2$ 100% | 0.75 | 1.932 |
| | | | $SrTiO_3$:10 | Ar 20% | | | |
| 3 | 880 | 830 | $FeAl_2O_4$:10 | 870 | 845 | 0.77 | 1.925 |
| | 20 | 100 | $CaTiO_3$:7 | 2 | 55 | | |
| | 10 | 55 | | $N_2$ 50% | $N_2$ 100% | | |
| | | | | Ar 50% | | | |
| 4 | 880 | 840 | | 865 | 845 | 0.75 | 1.928 |
| | 30 | 80 | | 1 | 65 | | |
| | 0 | 62 | | $N_2$ 90% | $N_2$ 100% | | |
| | | | | Ar 10% | | | |
| 5 | 865 | 830 | $MgAl_2O_4$:10 | 860 | 840 | 0.75 | 1.934 |
| | 20 | 90 | $TiO_2$:8 | 2 | 45 | | |
| | 0 | 65 | | $N_2$ 50% | $N_2$ 100% | | |
| | | | | Ar 50% | | | |

EXAMPLE 13

A slab of silicon steel comprising C: 0.040%, Si: 3.34%, Mn: 0.070%, Se: 0.021%, Sb: 0.025%, Cu: 0.13%, Mo: 0.013% and the balance being substantially Fe was heated to 1430° C. and hot rolled to a thickness of 1.4–2.4 mm. Then, the hot rolled sheet was subjected to a normalizing annealing at 975° C. for 1 minute, a first cold rolling to a middle thickness as shown in Table 13, an intermediate annealing at 1000° C. for 60 seconds and a second cold rolling to a final product thickness as shown in Table 13.

Thereafter, the cold rolled sheet was subjected to a decarburization annealing by heating at a temperature rising rate of 15° C./s and then keeping at 855° C. in an atmosphere having a dew point of 10° C. for 15 seconds and further keeping at 820° C. in $H_2$ atmosphere having a dew point of 60° C. for 80 seconds.

Figure 7:
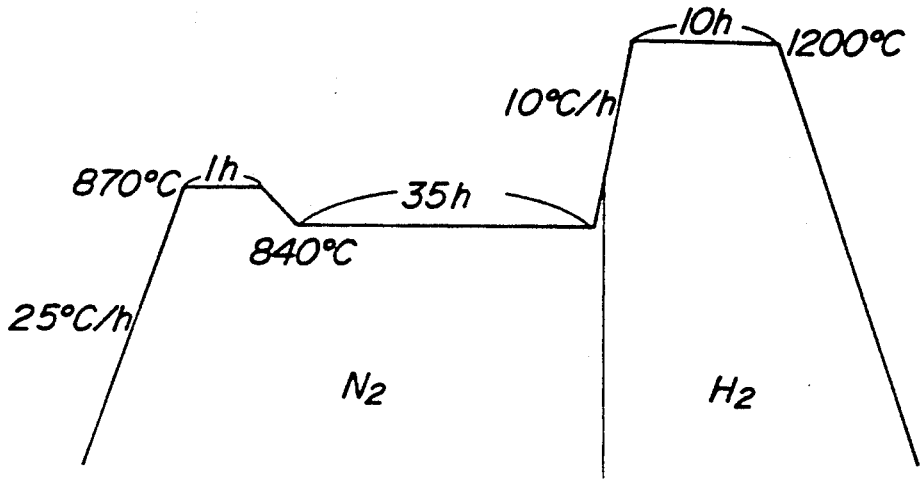

After a slurry of an annealing separator containing 5 parts by weight of $TiO_2$ and 15 parts by weight of $MgAl_2O_4$ based on 100 parts by weight of MgO was applied, the sheet was subjected to a final finish annealing according to a temperature pattern as shown in FIG. 7.

The magnetic properties of the thus obtained product sheets were measured to obtain results as shown in Table 13.

TABLE 13

| | Thickness in hot rolling (mm) | Middle thickness (mm) | Final thickness (mm) | Iron loss $W_{17/50}$ (W/kg) | Magnetic flux density $B_8$ (T) |
|---|---|---|---|---|---|
| 1 | 2.0 | 0.60 | 0.23 | 0.79 | 1.932 |
| 2 | 1.8 | 0.48 | 0.20 | 0.75 | 1.935 |
| 3 | 1.8 | 0.45 | 0.18 | 0.73 | 1.929 |
| 4 | 1.6 | 0.38 | 0.16 | 0.70 | 1.926 |
| 5 | 1.6 | 0.35 | 0.13 | 0.68 | 1.921 |

EXAMPLE 14

A slab of silicon steel having a chemical composition as shown in Table 14 was heated to 1430° C. and hot rolled to a thickness of 1.8 mm. Then, the hot rolled sheet was subjected to a normalizing annealing at 1000° C. for 1 minute, a first cold rolling to a thickness of 0.50 mm, an intermediate annealing at 1000° C. for 1 minute and a second cold rolling to a final product thickness of 0.20 mm.

Thereafter, the cold rolled sheet was subjected to a decarburization annealing by heating at a temperature rising rate of 20° C./s and keeping at 865° C. in an atmosphere having a dew point of 10° C. for 10 seconds and further keeping at 820° C. in $H_2$ atmosphere having a dew point of 60° C. for 90 seconds.

After a slurry of an annealing separator containing 5 parts by weight of $TiO_2$ and 15 parts by weight of $MgAl_2O_4$ based on 100 parts by weight of MgO was applied, the sheet was subjected to a final finish annealing according to a temperature pattern as shown in FIG. 7.

The magnetic properties of the thus obtained product sheets were measured to obtain results as shown in Table 14.

TABLE 14

| | Chemical composition (%) | | | | | | | | | Iron loss | Magnetic flux density |
|---|---|---|---|---|---|---|---|---|---|---|---|
| | C | Si | Mn | Se | Sb | Cu | Mo | Sn | Ge | $W_{17/50}$ (W/kg) | $B_8$ (T) |
| 1 | 0.042 | 3.32 | 0.069 | 0.021 | 0.026 | 0.08 | tr | tr | tr | 0.76 | 1.932 |
| 2 | 0.036 | 3.30 | 0.072 | 0.018 | 0.031 | 0.15 | 0.02 | tr | tr | 0.75 | 1.926 |
| 3 | 0.040 | 3.35 | 0.074 | 0.020 | 0.021 | 0.19 | 0.01 | 0.15 | tr | 0.75 | 1.930 |
| 4 | 0.043 | 3.28 | 0.065 | 0.022 | 0.026 | 0.12 | 0.02 | tr | 0.01 | 0.76 | 1.926 |
| 5 | 0.040 | 3.25 | 0.067 | 0.023 | 0.018 | 0.21 | tr | tr | 0.02 | 0.76 | 1.927 |
| 6 | 0.041 | 3.29 | 0.068 | 0.018 | 0.022 | 0.13 | tr | 0.13 | tr | 0.76 | 1.923 |
| 7 | 0.039 | 3.31 | 0.071 | 0.020 | 0.024 | 0.19 | tr | 0.10 | 0.02 | 0.74 | 1.930 |

According to the first invention, the formation of good texture and the complete decarburization can simultaneously be achieved by using MnSe and $Cu_{2-x}Se$ as an inhibitor and conducting the recrystallization aiming at the increase of Goss orientation at the first half of the decarburization annealing and the annealing aiming at the usual decarburization in the steel sheet, whereby grain oriented silicon steel sheets having good magnetic properties can stably be obtained.

According to the second invention, grain oriented silicon steel sheets having better magnetic properties can stably be obtained by using MnSe and $Cu_{2-x}Se$ as an inhibitor and carrying out the final finish annealing under particular conditions.

According to the third invention, grain oriented silicon steel sheets having better magnetic properties can stably be obtained by using MnSe and $Cu_{2-x}Se$ as an inhibitor and adding the spinel type composite oxide containing aluminum and the Ti compound to the annealing separator.

Moreover, grain oriented silicon steel sheets having considerably improved magnetic properties can stably be obtained by the combination of the first, second and third inventions.

What is claimed is:

1. A method of producing grain oriented silicon steel sheets having low iron loss from a slab of silicon steel comprising C: 0.02–0.08 wt %, Si: 2.5–4.0 wt %, Mn: 0.02–0.15 wt %, Se: 0.010–0.060 wt %, Sb: 0.01–0.20 wt %, Cu: 0.02–0.30 wt % and the balance substantially Fe, comprising hot rolling to make a sheet, subjecting the resulting hot rolled sheet to heavy cold rolling or two-stage cold rolling through an intermediate annealing up to a final product thickness, subjecting the resulting cold rolled sheet to decarburization annealing, applying a slurry of an annealing separator containing mainly MgO to the surface of the sheet, and then subjecting the sheet to secondary recrystallization annealing and purification annealing, characterized in that in said decarburization annealing the sheet is heated to 850°–1000° C. at a rate of not less than 10° C./s and is kept in that temperature range in a non-oxidizing atmosphere having a dew point of not higher than 15° C. for 5–60 seconds and that said sheet is further kept in a wet hydrogen atmosphere of 780°–850° C. for 30 seconds to 5 minutes.

2. A method of producing grain oriented silicon steel sheets having low iron loss from a slab of silicon steel comprising C: 0.02–0.08 wt %, Si: 2.5–4.0 wt %, Mn: 0.02–0.15 wt %, Se: 0.010–0.060 wt %, Sb: 0.01–0.20 wt %, Cu: 0.02–0.30 wt % and the balance being substantially Fe, comprising subjecting said slab to hot rolling, subjecting the resulting hot rolled sheet to heavy cold rolling or two-stage cold rolling through intermediate annealing up to a final product thickness, subjecting the resulting cold rolled sheet to decarburization annealing, applying a slurry of an annealing separator containing mainly MgO to the surface of the sheet, and then subjecting the sheet to secondary recrystallization annealing and purification annealing, characterized in that said final product thickness is 0.12–0.23 mm, and said secondary recrystallization annealing is a treatment wherein the sheet is heated to a temperature of 840°–900° C. at a rate of not less than 15° C./h and kept at that temperature in a mixed atmosphere of Ar and $N_2$ for 30 minutes to 5 hours and is further kept at a temperature lower by 20°–50° C. than the above temperature for not less than 20 hours.

3. A method of producing grain oriented silicon steel sheets having low iron loss from a slab of silicon steel comprising C: 0.02–0.08 wt %, Si: 2.5–4.0 wt %, Mn: 0.02–0.15 wt %, Se: 0.010–0.060 wt %, Sb: 0.01–0.20 wt %, Cu: 0.02–0.30 wt % and the balance substantially Fe, comprising subjecting said slab to hot rolling, subjecting the resulting hot rolled sheet to heavy cold rolling or two-stage cold rolling through intermediate annealing up to a final product thickness, subjecting the resulting cold rolled sheet to decarburization annealing, applying a slurry of an annealing separator containing MgO to the surface of the sheet, and then subjecting the sheet to secondary recrystallization annealing and purification annealing, characterized in that said final product thickness is 0.12–0.23 mm, and said annealing separator is added with 1–50 parts by weight of a spinel composite compound containing aluminum and 1–20 parts by weight of a Ti compound based on 100 parts by weight of MgO.

4. A method of producing grain oriented silicon steel sheets having low iron loss from a slab of silicon steel comprising C: 0.02–0.08 wt %, Si: 2.5–4.0 wt %, Mn: 0.02–0.15 wt %, Se: 0.010–0.060 wt %, Sb: 0.01–0.20 wt %, Cu: 0.02–0.30 wt % and the balance substantially Fe, comprising subjecting said slab to hot rolling, subjecting the resulting hot rolled sheet to heavy cold rolling or two-stage cold rolling through intermediate annealing up to a final product thickness, subjecting the resulting cold rolled sheet to decarburization annealing, applying a slurry of an annealing separator containing mainly MgO to the surface of the sheet, and then subjecting the sheet to secondary crystallization annealing and purification annealing, characterized by the fact that in said decarburization annealing the sheet is heated to 850°-1000° C. at a rate of not less than 10° C./s and kept in that temperature range in a non-oxidizing atmosphere having a dew point of not higher than 15° C. for 5-60 seconds and further kept in a wet hydrogen atmosphere of 780°-850° C. for 30 seconds to 5 minutes, and said final product thickness is 0.12-0.23 mm, and that in said secondary recrystallization annealing the sheet is heated up to a temperature of 840°-900° C. at not less than 15° C./h and kept at that temperature in a mixed atmosphere of Ar and $N_2$ for 30 minutes to 5 hours and further kept at a temperature lower by 20°-50° C. than the above temperature for not less than 20 hours.

5. A method of producing grain oriented silicon steel sheets having low iron loss from a slab of silicon steel comprising C: 0.02-0.08 wt %, Si: 2.5-4.0 wt %, Mn: 0.02-0.15 wt %, Se: 0.010-0.060 wt %, Sb: 0.01-0.20 wt %, Cu: 0.02-0.30 wt % and the balance being substantially Fe, comprising subjecting said slab to hot rolling, subjecting the resulting hot rolled sheet to heavy cold rolling or two-stage cold rolling through intermediate annealing up to a final product thickness, subjecting the resulting cold sheet to decarburization annealing, applying a slurry of an annealing separator containing MgO to the surface of the sheet, and then subjecting the sheet to secondary recrystallization annealing and purification annealing, characterized in that in said decarburization annealing the sheet is heated to 850°-1000° C. at a rate of not less than 10° C./s and kept in that temperature range in a non-oxidizing atmosphere having a dew point of not higher than 15° C. for 5-60 seconds and further kept in a wet hydrogen atmosphere at 780°-850° C. for 30 seconds to 5 minutes, and said final product thickness is 0.12-0.23 mm, and said annealing separator is added with 1-50 parts by weight of a spinel composite compound containing aluminum and 1-20 parts by weight of a Ti compound based on 100 parts by weight of MgO.

6. A method of producing grain oriented silicon steel sheets having low iron loss from a slab of silicon steel comprising C: 0.02-0.08 wt %, Si: 2.5-4.0 wt %, Mn: 0.02-0.15 wt %, Se: 0.010-0.060 wt %, Sb: 0.01-0.20 wt %, Cu: 0.02-0.30 wt % and the balance being substantially Fe, comprising subjecting said slab to hot rolling, subjecting the resulting hot rolled sheet to heavy cold rolling or two-stage cold rolling through an intermediate annealing up to a final product thickness, subjecting the resulting cold rolled sheet to decarburization annealing, applying a slurry of an annealing separator containing MgO to the surface of the sheet, and then subjecting the sheet to secondary recrystallization annealing and purification annealing, characterized in that in said decarburization annealing the sheet is heated to 850°-1000° C. at a rate of not less than 10° C./s and kept in that temperature range in a non-oxidizing atmosphere having a dew point of not higher than 15° C. for 5-60 seconds and further kept in a wet hydrogen atmosphere of 780°-850° C. for 30 seconds to 5 minutes, and said final product thickness is 0.12-0.23 mm, and said secondary recrystallization annealing is a treatment in which the sheet is heated up to a temperature of 840°-900° C. and a rate of not less than 15° C./h and kept at that temperature for 30 minutes to 5 hours and further kept at a temperature lower by 20°-50° C. than the above temperature for not less than 20 hours, and said annealing separator is added with 1-50 parts by weight of a spinel composite compound containing aluminum and 1-20 parts by weight of a Ti compound based on 100 parts by weight of MgO.

7. The method according to anyone of claims 1 to 6, wherein said slab of silicon steel comprises C: 0.02-0.08 wt %, Si: 2.5-4.0 wt %, Mn: 0.02-0.15 wt %, Se: 0.010-0.060 wt %, Sb: 0.01-0.20 wt %, Cu: 0.02-0.30 wt %, Mo: 0.005-0.05 wt % and the balance being substantially Fe.

8. The method according to anyone of claims 1 to 6, wherein said slab of silicon steel comprises C: 0.02-0.08 wt %, Si: 2.5-4.0 wt %, Mn: 0.02-0.15 wt %, Se: 0.010-0.060 wt %, Sb: 0.01-0.20 wt %, Cu: 0.02-0.30 wt %, at least one of Sn: 0.02-0.30 wt % and Ge: 0.005-0.50 wt % and the balance being substantially Fe.

9. The method according to anyone of claims 1 to 6, wherein said slab of silicon steel comprises C: 0.02-0.08 wt %, Si: 2.5-4.0 wt %, Mn: 0.02-0.15 wt %, Se: 0.010-0.060 wt %, Sb: 0.01-0.20 wt %, Cu: 0.02-0.30 wt %, Mo: 0.005-0.05 wt %, at least one of Sn: 0.02-0.30 wt % and Ge: 0.005-0.50 wt % and the balance being substantially Fe.

* * * * *

UNITED STATES PATENT AND TRADEMARK OFFICE

CERTIFICATE OF CORRECTION

PATENT NO. : 5,306,353

DATED : April 26, 1994

INVENTOR(S) : Yasuyuki Hayakawa et al

It is certified that error appears in the above-indentified patent and that said Letters Patent is hereby corrected as shown below:

Column 22:

In Table 9, under the column "Iron Loss $W_{17/50}$ (W/kg)" kindly delete the third entry "0.80".

In Table 9, under the column "Magnetic flux density $B_8$(T)" kindly delete the third entry "1.912".

Signed and Sealed this

Ninth Day of August, 1994

Bruce Lehman

*Attest:*

BRUCE LEHMAN

*Attesting Officer*

*Commissioner of Patents and Trademarks*